United States Patent [19]

Baker et al.

[11] 4,411,315

[45] Oct. 25, 1983

[54] DRAG SPRING UNIT

[75] Inventors: Randy S. Baker, Long Beach, Calif.; H. R. Price, Calgary, Canada

[73] Assignee: Hughes Tool Company, Houston, Tex.

[21] Appl. No.: 278,915

[22] Filed: Jun. 29, 1981

[51] Int. Cl.[3] ..... E21B 23/04; E21B 23/06

[52] U.S. Cl. ..... 166/187; 166/237; 166/241; 166/334

[58] Field of Search ..... 166/187, 237, 240, 106, 166/241, 334; 175/325, 298

[56] References Cited

U.S. PATENT DOCUMENTS

| | | | |
|---|---|---|---|
| 2,549,198 | 4/1951 | Hayward | 166/134 |
| 3,439,740 | 4/1969 | Conover | 166/250 |
| 3,572,450 | 3/1971 | Thompson | 175/325 X |
| 3,876,000 | 4/1975 | Nutter | 166/106 |
| 4,246,964 | 1/1981 | Brandell | 166/106 |

*Primary Examiner*—Ernest R. Purser

*Attorney, Agent, or Firm*—Robert A. Felsman; Charles D. Gunter, Jr.

[57] ABSTRACT

An improved drag string unit is shown for use with well bore drill stem test tools of the type which have an inflatable packer and an integral pump. The drag spring unit has an outer drag spring housing and an inner mandrel slidably received within the drag spring housing. Ratchet surfaces associated with the outer housing and inner mandrel are positionable between an engaged position which allows the pump to be activated to pump up the packers and a disengaged position which prevents activation of the pump. Vent means are alignable between the inner mandrel and outer housing when the ratchet surfaces are disengaged allowing the packers to vent to the well bore.

6 Claims, 4 Drawing Figures

DRAG SPRING UNIT

BACKGROUND OF THE INVENTION

This invention relates generally to drill stem test tools of the type used in oil drilling operations to test potential producing formations and specifically to an improved drag spring unit for well bore drill stem test tools.

Drill stem test (DST) tools are mounted in the drill stem or string and are used to evaluate the producing potential or productivity of an oil or gas bearing zone prior to completing a well. Thus, as drilling proceeds, various indications such as core samples may suggest the desirability of testing a certain formation for producing potential. To conduct the test, an inflatable packer and valve assembly is lowered on the drill stem into the uncased well bore to the zone to be tested. The packer is then set and the valve is opened for flow to the well surface.

Mechanical packers typically utilize a rubber diaphragm which is mechanically deformed outward toward the sides of the well bore by setting weight down on the tool, thereby isolating the zone to be tested. Inflatable packers have distensible members along the tool which are inflated by an integral pump. Rotation of the drill string activates the integral pump thereby pumping fluid to the packers to cause inflation. Inflatable packer type DST tools utilize a drag spring to anchor the lower end of the tool to the sides of the well bore. Rotation of the drill string from the surface while holding the lower end in place actuates the integral pump and inflates the packers.

In the past, one of the most time consuming operations of an inflatable packer drill stem test was removing the drill pipe and tools from the well bore after the test had been run. The normal method of removing drill pipe, other than pipe incorporating an inflatable packer DST tool, involves breaking and threaded connection (tool joint) with the rig tongs and then spinning the rotary table clockwise to unscrew the threads. Clockwise rotation of the rotary table turns the entire amount of drill pipe left in the well bore, along with any tools that are attached to the drill pipe. Since inflatable packer DST tools utilize a pump which is operated by right hand rotation of the rotary table, each time a stand of drill pipe is removed, the pump is turned a few revolutions which gradually pumps the packers up. This is undesirable because it prevents further pipe removal until the packers can be deflated again. It can also result in the packers becoming stuck or damaged.

Because of these problems, drilling crews now use a special procedure to remove drill strings incorporating inflatable packer DST tools. Chain tongs are attached to the stand pipe being removed and the crew walks around the rotary table counterclockwise to unscrew the joint. Although this solves the problem of gradual packer inflation, it is time consuming. Normal operations must be stopped for each stand of pipe being removed so that the chain tongs can be attached and physically walked around the rotary table several times.

SUMMARY OF THE INVENTION

An improved drag spring unit for well bore DST tools is shown. The improved drag spring unit has an outer drag spring housing and an inner mandrel slidably received within the outer drag spring housing. Clutch means associated with the outer housing and inner mandrel are positionable between an engaged position whereby rotation of the inner mandrel causes rotation of the outer housing and activation of the packer pump and a disengaged positioned allowing independent rotation of the inner mandrel without activating the pump.

In a preferred embodiment, the outer housing has an upper body with a ratchet surface on one end, a lower body, and a drag spring connecting the upper and lower bodies. The inner mandrel has a connector sub at one end having a ratchet surface which contacts the upper body ratchet surface. Selective positioning of the opposing ratchet surfaces either allows or prevents rotation of the inner mandrel and hence activation of the pump. A coil spring is preferably provided around the inner mandrel and positioned between the upper and lower bodies of the outer housing for urging the ratchet surfaces toward the engaged position. A port in the upper body of the outer housing and a fluid passageway in the inner mandrel are alignable to vent the packers to the well bore when the ratchet surfaces are disengaged.

Additional objects, features, and advantages of the invention will be apparent in the following description.

DETAILED DESCRIPTION OF THE INVENTION

Figure 1:
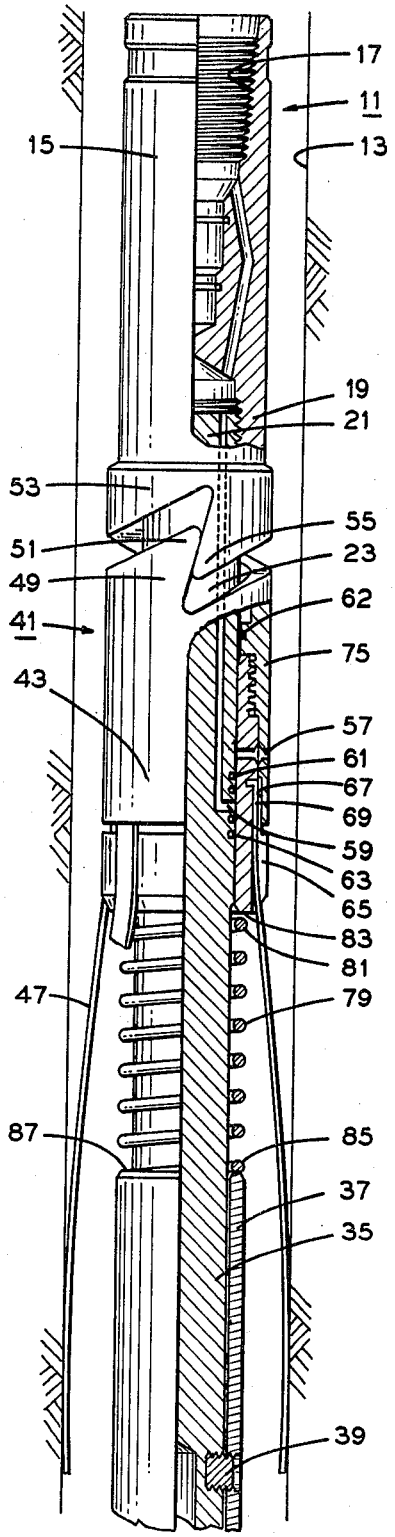
FIG. 1 is a side view of the upper half of the drag spring unit of this invention in the engaged position, partially borken away for ease of illustration.

Referring now to FIG. 1 there is shown a drag spring unit designated generally as 11 in place in the well bore 13. Drag spring unit 11 has a connector sub 15 at the upper end having an internally threaded end 17 for connection in the drill string. For purposes of this discussion, "upper" or "top" will mean in the direction of threaded end 17 it being understood that end 17 is the last part of the unit to enter the well bore 13. The end 19 of connector sub 15 opposite threaded end 17 is threadedly connected to the top end 21 of inner mandrel 23.

Inner mandrel 23 is an elongated rod-shaped member having an internal bore 25 (FIG. 2) running from the lower end 27 along a portion of its length and is of lesser external diameter than the external diameter of cylindrical connector sub 15. Inner mandrel 23 can also be a solid rod along its entire length. The end 27 of inner mandrel 23 opposite end 21 is threadedly connected to a terminal sub 29. Terminal sub 29 is generally cylindrical in shape and has a greater external diameter than inner mandrel 23 forming a shoulder 31 at the threaded connection 33. The end 34 of terminal sub 29 opposite shoulder 31 is externally threaded to mate with the internally threaded portion 36 of an end piece 38. End piece 38 and terminal sub 29 can conveniently be provided with an internal bore 40 to lessen manufacturing costs or can be solid pieces. The mid-section 35 of inner mandrel 23 is surrounded by a spacer sleeve 37 which is connected to inner mandrel 23 by means of a pipe plug 39. Spacer sleeve 37 is cylindrically shaped and has an internal diameter slightly greater than the external diameter of inner mandrel 23.

Inner mandrel 23 is slidably received within an outer drag spring housing 41 comprising an upper cylindrical body 43, a lower cylindrical body 45, and at least one drag spring 47 connecting the upper body 43 and lower body 45. Upper cylindrical body 43 of outer housing 41 has a ratchet surface 49 including a plurality of teeth 51 at the upper end thereof.

Figure 3:
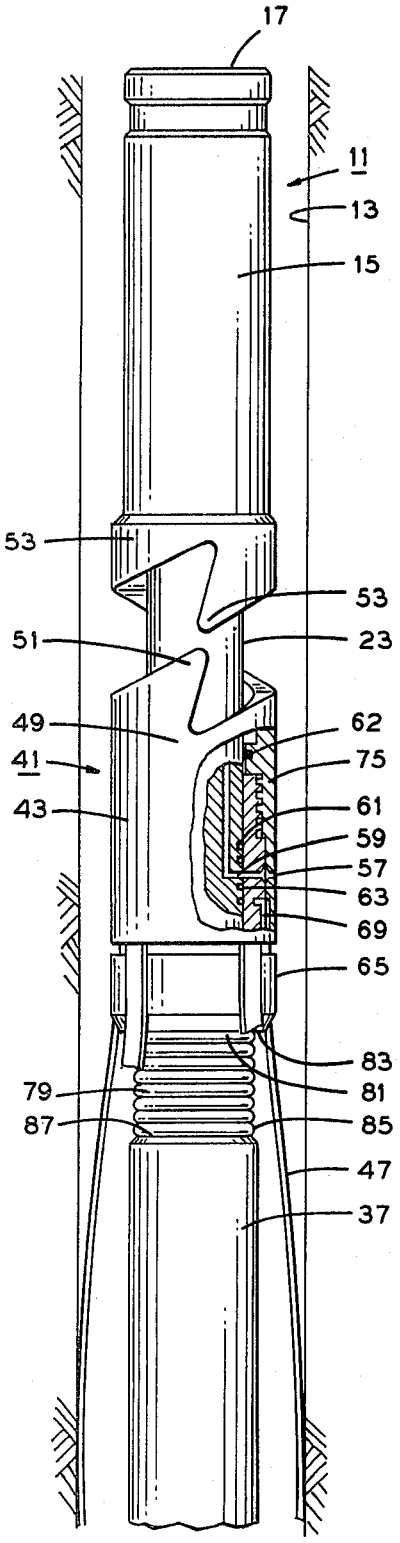
FIG. 3 is a side view of the lower half of the device of FIG. 1 in the disengaged position, partially broken away.
Figure 4:
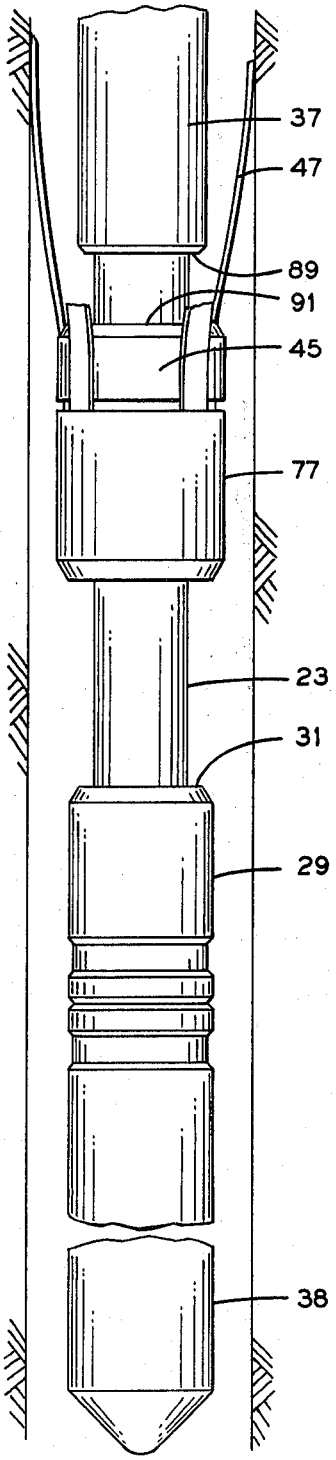
FIG. 4 is a side view of the lower body half of the device of FIG. 3.

Ratchet surface 49 of upper body 43 contacts a matching surface 53 of connector sub 15 having teeth 55 which matingly engage teeth 15 of upper body 43. Upper body ratchet surface 49 and connector sub ratchet surface 53 together comprise clutch means associated with the outer drag spring housing 41 and inner mandrel 23. Ratchet surfaces 49, 53 are positionable between an engaged position as shown in FIG. 1 which allows the packer pump (not shown) to be activated and a disengaged position as shown in FIG. 3 which prevents actuation of the pump. Upper body 43 has an external port 57 which communicates with the well bore 13 and which is alignable with a fluid passageway 59 in inner mandrel 23. As shown in FIGS. 1 and 3, movement of the ratchet surfaces 49, 53 from the engaged to the disengaged positions serves to align fluid passageway 59 in inner mandrel 23 with external port 57 in upper body 43. When ratchet surfaces 49, 53 are in the engaged position as shown in FIG. 1, fluid passageway 59 is isolated from external port 57 by means of upper and lower O-rings 61, 63 respectively. A wiper ring 62 in upper body 43 keeps debris from becoming trapped between upper body 43 and inner mandrel 23.

The lower end 65 of upper body 43 has a plurality of slots 67 arranged about the circumference for receiving the upper end 69 of a plurality of drag springs 47. The ends 71 of drag springs 47 opposite ends 69 are received within matching slots 73 of lower body 45. Outer extent 75 of upper body 43 and outer extent 77 of lower body 45 thread onto upper body 43 and lower body 45 to retain drag springs 47 in slots 67, 73 respectively.

A biasing means such as helical spring 79 surrounds inner mandrel 23 and is positioned between upper body 43 and lower body 45 for urging ratchet surfaces 49, 53 toward the engaged position as shown in FIG. 1. The upper end 81 of spring 79 contacts the bottom surface 83 of upper body 43. The lower end 85 of spring 79 rides on the shoulder 87 formed between spacer sleeve 37 and the exterior of inner mandrel 23.

Figure 2:
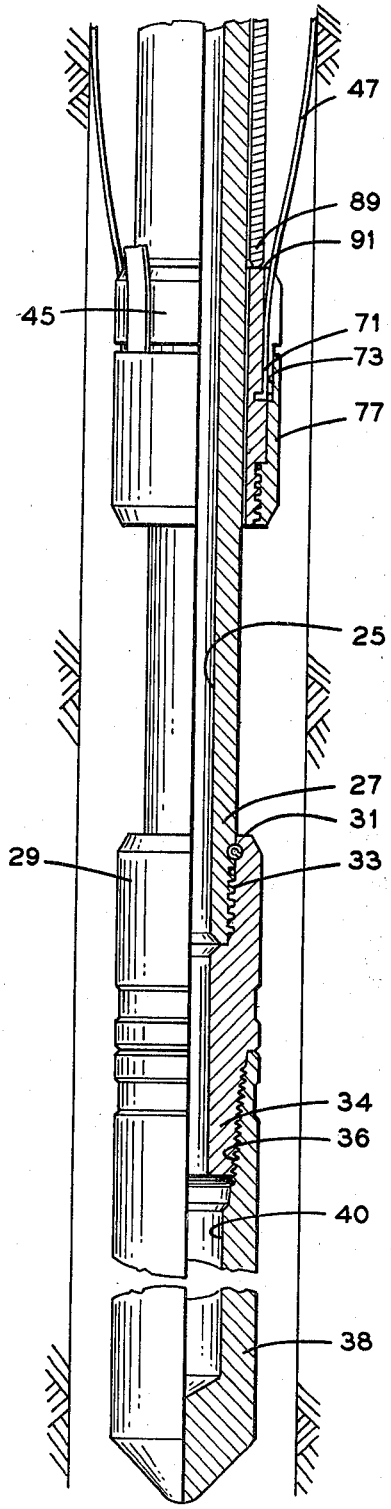
FIG. 2 is a side view of the lower half of the device of FIG. 1, partially broken away.

The operation of the drag spring unit will now be described in greater detail. FIGS. 1 and 2 show the drag spring unit of the present invention in place in the well bore prior to beginning inflation of the packers. The end 89 of spacer sleeve 37 opposite shoulder 87 is resting on the top surface 91 of lower body 45. Spring 79 between bottom surface 83 of upper body 43 and shoulder 87 of spacer sleeve 37 urges ratchet teeth 51, 55 toward the engaged position. The drag springs 47 are bowed outward and contact the well bore anchoring the unit in place at the desired location in the well bore. The packers, located above the drag spring unit in the drill string would now be activated by rotating the drill string in a clockwise direction from the rotary table. Since the drag spring unit 11 anchors the lower end of the drill stem in place, rotation of the drill string from the surface activates the integral pump and pumps up the packers in the usual manner.

Assume now that the test is complete and the packers have been deflated by a suitable series of manipulations of the drill string from the well surface. A stand of pipe is now raised above the rotary table in the drill rig, the tool joint is broken out, and the joint is spun loose. As pipe in the drill string above drag spring unit 11 is pulled upward, ratchet teeth 51, 55 are disengaged as shown in FIG. 3 allowing independent rotation of the inner mandrel 23. Since the bottom of the drill string is now free to rotate, rotation of the drill string at the surface can be accomplished without activating the packer pump. Upward force on connector sub 15 acts through spacer sleeve 37 and spring 79 causing spring 79 to bottom out as shown in FIG. 3 against bottom surface 83 of upper body 43. In this way, the force on drag spring housing 41 is exerted on upper body 43 above drag springs 47 when coming out of the well bore thereby keeping drag springs 47 from bowing out further against the sidewalls of the well bore. As shown in FIGS. 1 and 2, the opposite principle is employed when placing the tool in the well bore. Downward force exerted through the drill string on connector sub 15 acts through spacer sleeve 37 on top surface 91 of lower body 45 thereby pushing the drag spring housing 41 from the lower body 45 and keeping drag springs 47 in closer to the unit sidewalls.

As the tool is being pulled up to the surface, port 57 in upper body 43 is aligned with fluid passageway 59 in inner mandrel 23 (FIG. 3). Fluid passageway 59 communicates with the inflation and deflation passage of the pipe string above connector sub 15 and hence with the interior of the packers. Any fluid which might inadvertently accumulate in the packers is vented to the well bore through fluid passageway 59 and external port 57 during retrieval operations.

Thus, even if a small amount of fluid is pumped into the packers each time a stand of pipe is rotated, the fluid is vented through port 57 and fluid passageway 59 as soon as the next stand of pipe is pulled up for removal. As shown in FIG. 1, when the tool is placed in the well bore for testing, port 57 is isolated from fluid passageway 59.

An invention has been provided with significant advantages. The present drag spring unit for well bore drill stem test tools of the type having inflatable packers and an integral pump allows the drill string to be removed from the well bore without special operating procedures. The upper body ratchet surface and connector sub ratchet surface can be selectively positioned between an engaged position whereby rotation of the drill string activates the packer pumps and a disengaged position which allows independent rotation of the inner mandrel without activating the pump. Vent means alignable between the inner mandrel and outer housing vent the packers to the well bore when the ratchet surfaces are disengaged. Biasing means urge the ratchet surfaces toward the engaged position and distribute force on the drag spring housing during placement and retrieval of the tool.

The ratchet surfaces function as an anti back-off mechanism during placement and retrieval operations to prevent the drag spring unit from backing-off threaded connections in the pipe string. That is, by positioning the ratchet surfaces in the disengaged position, the drag springs are prevented from transmitting left hand or right hand torque which might unscrew, or back-off, the tool joint connections in the pipe string causing tools to be dropped in the well bore.

While the invention has been shown in only one of its forms, it should be apparent that it is not so limited but is susceptible to various changes and modifications without departing from the spirit thereof.

We claim:

1. An improved drag spring unit for well bore drill stem test tools of the type having an inflatable packer and an integral pump, said pump being activated by rotation of the drill stem in the well bore to inflate said packer, wherein the improvement comprises:

an outer drag spring housing;

an inner mandrel slidably received within said drag spring housing; and clutch means associated with said outer housing and inner mandrel, said clutch means being positionable by sliding said inner mandrel within said drag spring housing between an engaged position which allows torque transmitted to said drag spring housing to be transmitted through the drill stem to said pump and a disengaged position which prevents transmission of torque.

2. An improved drag spring unit for well bore drill stem test tools of the type having an inflatable packer and an integral pump, said pump being activated by rotation of the drill stem in the well bore to inflate said packer, wherein the improvement comprises:

an outer drag spring housing, said housing having an upper body having a ratchet surface on one end, a lower body, and a drag spring connecting said upper and lower bodies;

an inner mandrel slidably received within said outer drag spring housing, said inner mandrel having a connector sub at one end having a ratchet surface which contacts said upper body ratchet surface; and said upper body ratchet surface and said connector sub ratchet surface being positionable by sliding said inner mandrel within said spring housing between an engaged position which allows torque transmitted to said drag spring housing to be transmitted through the drill stem to said pump and a disengaged position which prevents transmission of torque.

3. An improved drag spring unit for well bore drill stem test tools of the type having an inflatable packer and an integral pump, said pump being activated by rotation of the drill stem in the well bore to inflate said packer, wherein the improvement comprises:

an outer drag spring housing, said housing having an upper body having a ratchet surface on one end, a lower body, and a drag spring connecting said upper and lower bodies;

an inner mandrel slidably received within said outer drag spring housing, said inner mandrel having a connector sub at one end having a ratchet surface which contacts said upper body ratchet surface;

said upper body ratchet surface and said connector sub ratchet surface being positionable by sliding said inner mandrel within said spring housing between an engaged position which allows torque to be transmitted to said drag spring housing to be transmitted through the drill stem to said pump and a disengaged position which prevents transmission of torque; and a coil spring surrounding said inner mandrel and positioned between said upper and lower body of said outer housing for urging said ratchet surfaces toward said engaged position.

4. An improved drag spring unit for well bore drill stem test tools of the type having an inflatable packer and an integral pump, said pump being activated by rotation of the drill stem in the well bore to inflate said packer, wherein the improvement comprises:

an outer drag spring housing, said housing having an upper body having a ratchet surface on one end, a lower body, and a drag spring connecting said upper and lower bodies;

an inner mandrel slidably received within said outer drag spring housing, said inner mandrel having a connector sub at one end having a ratchet surface which contacts said upper body ratchet surface;

said upper body ratchet surface and said connector sub ratchet surface being positionable between an engaged position whereby rotation of said inner mandrel causes activation of said pump, and a disengaged position allowing independent rotation of said inner mandrel without activating said pump;

a coil spring surrounding said inner mandrel and positioned between said upper and lower body of said outer housing for urging said ratchet surfaces toward said engaged position; and vent means alignable between said inner mandrel and said outer housing to vent said packers to said well bore when said ratchet surfaces are disengaged.

5. The improved drag spring unit of claim 4, wherein said vent means comprises a port in said upper body of said outer housing and a fluid passageway in said inner mandrel, movement of said ratchet surfaces from said engaged to said disengaged positions serving to align said port and fluid passageway.

6. The improved drag spring unit of claim 5, further comprising a spacer sleeve attached to said inner mandrel below said coil spring and above said lower body, whereby downward force on said connector sub is transmitted to said lower body through said spacer sleeve and upward force on said connector sub is transmitted to said upper body through said spacer sleeve and coil spring.

* * * * *